United States Patent [19]

Thompson

[11] Patent Number: 4,486,628

[45] Date of Patent: Dec. 4, 1984

[54] BACTERIA DESTROYING APPARATUS FOR USE WITH VOICE COMMUNICATION SYSTEMS

[76] Inventor: Virley P. Thompson, 6700 Franklin Ave., Los Angeles, Calif. 90028

[21] Appl. No.: 236,906

[22] Filed: Feb. 23, 1981

[51] Int. Cl.[3] ..... H04R 1/12

[52] U.S. Cl. ..... 179/185; 174/69

[58] Field of Search ..... 179/185; 250/439, 455; 174/69

[56] References Cited

U.S. PATENT DOCUMENTS

| | | | |
|---|---|---|---|
| 2,911,488 | 11/1959 | Quintas | 179/185 |
| 3,049,597 | 8/1962 | Koop | 179/185 |
| 3,272,927 | 9/1966 | Peebles | 179/185 |
| 3,348,006 | 10/1967 | Brand | 179/185 |
| 4,357,500 | 11/1982 | Nilsen | 174/69 |

FOREIGN PATENT DOCUMENTS

| | | | |
|---|---|---|---|
| 1920027 | 4/1969 | Fed. Rep. of Germany | 179/69 |
| 676980 | 8/1952 | United Kingdom | 179/69 |

*Primary Examiner*—Gene Z. Rubinson
*Assistant Examiner*—L. C. Schroeder
*Attorney, Agent, or Firm*—Robert J. Schaap

[57] ABSTRACT

A bacteria destroying apparatus for use with a voice communication system such as a telephone system, and telephone systems which have such bacteria destroying apparatus included therewith. The bacteria destroying apparatus may adopt the form of a relatively thin, flat disc which is located in the mouthpiece of a telephone handset, and preferably in close proximity to the diaphram of the handset or any other portion of the voice communication system which normally collects a substantial amount of bacteria thereon as, for example, a result of close proximity of a user's mouth. The bacteria destroying apparatus generates radiation in a wave length range which is effective to destroy bacteria. In one embodiment, the radiation is generated when the element itself is electrically energized. The apparatus also includes an electrically conductive member such as a cable which extends through a portion of the voice communication system, and preferably the telephone handset, for connection to the radiation generating element as well as to a source of electrical power. Thus, when energized, radiation will be effective to destroy any bacteria on the mouthpiece of the telephone handset or other area which is contacted by the radiation. A switch system is provided for effectively disconnecting the radiation generating element from the source of electrical power when the telephone handset is in use.

8 Claims, 5 Drawing Figures

BACTERIA DESTROYING APPARATUS FOR USE WITH VOICE COMMUNICATION SYSTEMS

BACKGROUND OF THE INVENTION

1. Field of the Invention

This invention relates in general to certain new and useful improvements in bacteria destroying apparatus, and more particularly, to bacteria destroying apparatus of the type which can generate radiation in a wave length effective to destroy bacteria in a telephone communication system.

2. Brief Description of the Prior Art

Heretofore, there has not been any effective method or means for destroying bacteria which normally accumulates in a conventional telephone handset. This problem is particularly pronounced in the case of coin operated telephones which are normally located in commercial establishments and other areas for use by the public in general. Thus, a user may often transmit to the mouthpiece of the telephone instrument, such as the mouthpiece on a telephone handset, various bacteria or other germs from the user. This bacteria, for example, collects on the mouthpiece and if a subsequent user uses the same telephone instrument, prior to the time that the bacteria would normally die when exposed to the external atmosphere, such subsequent user might be subjected to contact by the same bacteria or virus.

There have not been any effective devices for destroying the bacteria which collects on or in a telephone instrument without creating any harmful effects to the users of such telephone instruments. There have been several proposals to subject the telephone instrument to a source of radiation external to the instrument itself for destroying any bacteria which might collect on the instrument and particularly the mouthpiece of a telephone handset. However, these devices are temporary in nature and must be turned off and on. There have also been several proposals to employ lights generating certain selected radiation within a telephone handset itself. However, and here again, these proposals resulted in very bulky devices which necessitated redesign of the telephone handset and were also not very effective. In addition, such devices were quite costly to manufacture.

The present invention overcomes these and other problems in the provision of a radiation generating device in the form of a relatively small, flat and thin disc which is capable of being located in a telephone instrument and which is also designed to generate radiation within a wave length sufficient to destroy any bacteria or virus collecting on the telephone instrument and which is also sufficient to deenergize the device when the telephone is used so that the user of the device will not be subjected to any exposure of harmful radiation.

OBJECTS OF THE INVENTION

It is, therefore, a primary object of the present invention to provide a device for use with voice communication systems which is capable of generating radiation within a wave length range sufficient to destroy bacteria which might collect on the telephone instrument by virtue of use thereof, and which can also be effectively deenergized during use of the instrument.

It is another object of the present invention to provide a device of the type stated which is capable of generating radiation of a wave length sufficient to destroy bacteria and which may adopt the form of a thin, flat disc located in the telephone instrument.

It is a further object of the present invention to provide a device of the type stated which can be located near the mouthpiece of a telephone handset and in close proximity to the diaphram of a telephone instrument for purposes of destroying bacteria which might collect on the mouthpiece.

It is still another object of the present invention to provide a device of the type stated which is highly effective in its operation, which can be manufactured at a relatively low unit cost and which does not subject the user of the telephone instrument in any exposure of harmful radiation.

It is another salient object of the present invention to provide a method of generating radiation within a wave length sufficient to destroy bacteria which might collect in a telephone instrument by virtue of use thereof.

It is still a further object of the present invention to provide a method of the type stated which automatically deenergizes the radiation generating element when the telephone instrument is in use to thereby prevent the exposure of the user to any harmful radiation.

With the above and other objects in view, my invention resides in the novel features of form, construction, arrangement, and combination of parts presently described and pointed out in the claims.

SUMMARY OF THE DISCLOSURE

A bacteria destroying apparatus for use with a voice communications system which employs a movable diaphram and an outer portion over said diaphram and which normally collects a substantial amount of bacteria thereon. The apparatus generally comprises a radiation generating element capable of being located in close proximity to the outer portion of the voice communication system. This radiation generating element is of the type capable of generating radiation within a wave length range which is effective to destroy such bacteria when the radiation generating element is electrically energized and which radiation will contact the outer portion of said telephone instrument. The apparatus also comprises an electrically conductive means extending through a portion of the voice communication system and which is operatively connected to the radiation generating element. This conductive means is adapted for ultimate connection to a source of electrical power in order to enable energization of the radiation generating element and ultimate generation of the radiation.

In another aspect of the invention, the bacteria destroying apparatus is constructed so that the radiation generating element is capable of generating ultraviolet radiation. In this respect, it is preferable to generate ultraviolet radiation within the wave length desired for destroying bacteria. This does not imply that the radiation which is so generated is only within the ultraviolet wave length range but has a substantial portion thereof which is in the ultraviolet wave length range. Thus, other radiation could include radiation of wave length which is not defined as being "ultraviolet" so long as a substantial portion e.g., at least 50% of the radiation is within the ultraviolet radiation wave length range.

In addition to the above, the apparatus is described as destroying bacteria which normally collects on voice communication systems, such as telephone instruments. In this respect, it should be understood that the term "bacteria" is used in a broad and generic sense to encompass virus and other forms of germs which might collect on a telephone instrument by virtue of use, and particularly, the term "bacteria" is used in connection with that bacterial including virus and other forms of germs which might be generated at the user's mouth and thereby collect on the telephone instrument.

As indicated above, the voice communication system is a telephone set and the outer portion thereof may constitute the mouthpiece of the telephone handset. The radiation generating element, preferably adopts the form of a relatively thin flat disc and particularly, a disc which is sized so that it can be easily inserted within an existing telephone instrument handset without necessitating reconstruction of the handset.

The electrically conductive means, preferably comprises an electrical conductor which is connected to the disc and which extends outwardly of the telephone system for connection to a source of electrical power which is independent of the voice communication system. In the preferred embodiment, the electrical conductor may extend actually through the handset and be carried with the telephone cable connecting the handset to the base of the telephone instrument.

In a preferred aspect of the invention, a switch means is provided and which is operatively connected to the electrically conductive means and may also be operatively connected to the radiation generating means. This switch means is effective to enable deenergization of the radiation generating element when the voice communication system is in use, and which permits energization of the radiation generating element and hence generation of the radiation when the instrument is not in use. This feature protects the user from being subjected to exposure of any harmful radiation.

The present invention also provides a method of destroying bacteria which normally collects in substantial amounts on a voice communication system of the type which employs a movable diaphram and an outer casing over the diaphram. The method provides for the locating of a radiation generating element in the casing and which is also capable of generating radiation in a wave length range effective to destroy bacteria when the radiation generating element is electrically energized. This radiation will contact the outer surface of the casing. The method provides for connecting an electrically conductive means through a portion of the voice communication system, and preferably through the telephone handset, to the radiation generating element and to a source of electrical power for purposes of energizing the radiation generating element.

In one embodiment of the invention the apparatus provided is capable of being used in a normal telephone handset so that the radiation generating element, in the form of a thin flat disc, is merely inserted in the mouthpiece of the telephone handset and electrically connected throught the handset. In another embodiment, the telephone handset itself is not opened but the radiation generating element is disposed externally of the handset and covered by a separate outer cover.

This invention possesses many other advantages and has other purposes which may be made more clearly apparent from a consideration of the forms in which it may be embodied. These forms are shown in the drawings forming part of and accompanying the present specification. They will now be described in detail for the purposes of illustrating the general principals of the invention, but it is to be understood that such detailed descriptions are not be taken in a limiting sense.

BRIEF DESCRIPTION OF THE DRAWINGS

Figure 1:
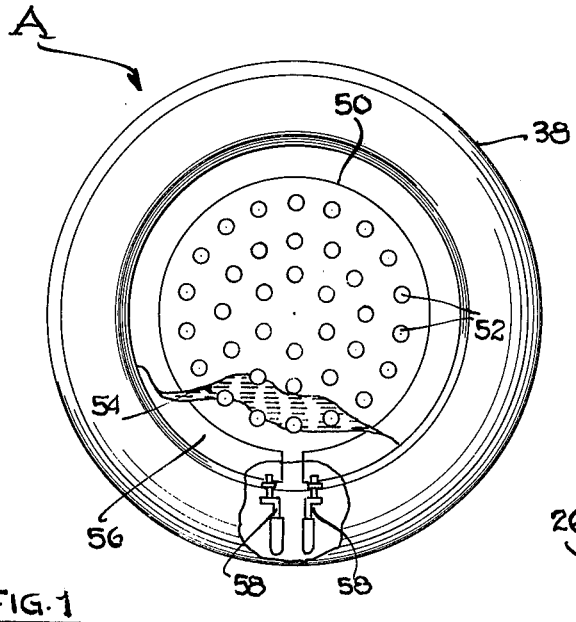
Figure 2:
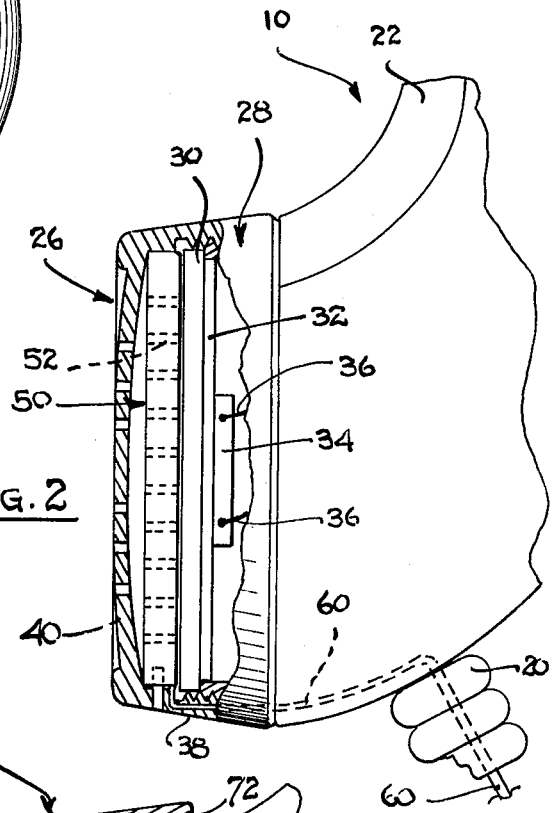
Figure 4:
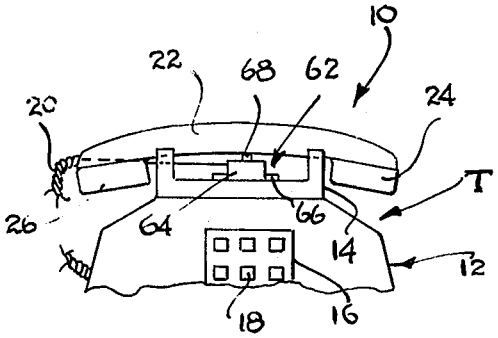
Figure 5:
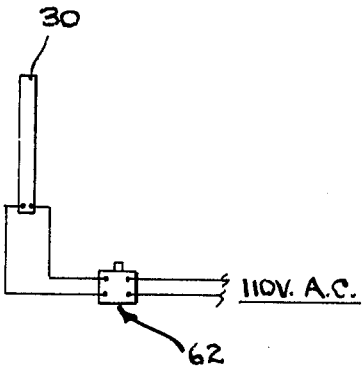
Figure 3:
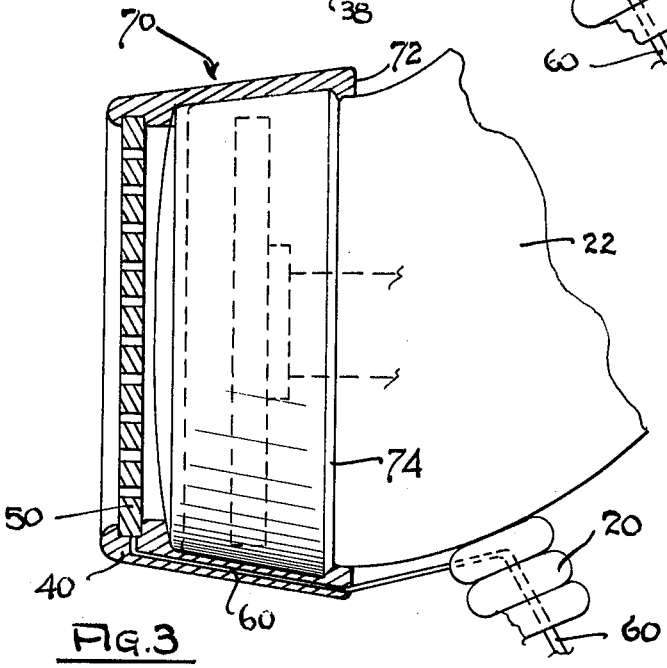

Having thus described the invention in general terms, reference will now be made to the accompanying drawings in which:

FIG. 1 is a front elevational view, partially broken away, of a bacteria destroying apparatus used in connection with a telephone handset;

FIG. 2 is a side elevational view, partially broken away and in section, and showing the use of the bacteria destroying apparatus in FIG. 1;

FIG. 3 is a side elevational view, similar to FIG. 2, and showing a modified form of bacteria destroying apparatus used in connection with a telephone instrument handset;

FIG. 4 is a front elevational view of a conventional telephone instrument with a switch mechanism forming part of the apparatus of the invention used in connection with a telephone handset; and FIG. 5 is a schematic view showing the electrical connection of the switch mechanism and the radiation generating element to a source of electrical power.

DETAILED DESCRIPTION OF PREFERRED EMBODIMENTS

Referring now in more detail and by reference characters to the drawings which illustrate practical embodiments of the present invention, A designates a bacteria destroying apparatus which is capable of being used with a conventional telephone sysem. In the embodiment as illustrated, the bacteria destroying apparatus is illustrated as being used with a conventional telephone handset 10.

By reference to FIG. 4, it can be observed that the handset 10 forms part of a telephone instrument T which is comprised of a base housing 1 and a cradle portion 14 integrally formed with the housing 12. Further, the base housing 12 is provided with means for generating a signal to select and create a communication link with another telephone instrument. This means may adopt the form of a touch-tone pad 16 containing a plurality of inputs such as input push button switches 18. Further, the conventional telephone instrument T is provided with an electrical cable 20 connecting the telephone base housing 12 to the handset 10 in the manner as illustrated in FIG. 4 of the drawings. The remaining portion of the telephone instrument itself is conventional and therefore neither illustrated or described in further detail herein, except for the portions of the handset which are pertinent to the present invention.

The telephone handset 10 is comprised of an elongate handle 22 having a voice receiving section or so-called earpiece 24 and a voice generating section or so-called "mouthpiece" 26, in the manner as illustrated in FIG. 4. The mouthpiece or voice generating section is more fully illustrated in FIG. 2 of the drawings. In this case, the mouthpiece generally comprises a signal generating unit 28 which is capable of generating an electrical signal representative of a voice. The signal generating unit generally comprises a thin flat housing 30 which contains a diaphram 32. On the rearward side of the diaphram 32 is a transformer coil 34 having one or more electrical leads 36 in the manner as illustrated. This portion of the signal generating unit is only schematically illustrated for the purposes of more fully understanding the present invention. The leads 36 are ultimately connected through the base housing 12 for transmitting the generated electrical signals and hence a voice which is represented by the electrical signals.

The signal generating mechanism 28 is retained within the housing by a threadedly attachable end cap 38 and which is provided with a perforated cover plate 40, also in the manner as illustrated in FIG. 2.

Located adjacent to the housing 30 and forming part of the apparatus A is a radiation generating means, often referred to as a "radiation generating element" 50 and which is present in the form of a thin, flat disc. In the embodiment as illustrated, the disc 50 is provided with a series of holes or perforations 52 to permit the passage of sound through the end cap 38 and to the housing 30. In accordance with conventional sound theory, the mass impact of the sound waves will cause the diaphram 32 to vibrate and thereby cause the transformer coil 34 to generate electrical signals which correspond to the voice generated sound waves, all in accordance with conventional theory. These signals are transmitted through the handset 10 and also through the telephone instrument also in accordance with well known telephone operation.

The radiation generating element 50 is provided on one of its surfaces and preferably the rearwardly presented surface with a sheet foil 54, also preferably a metal foil which cooperates with the element 30 in order to provide for distribution of the generated electro-magnetic radiation of the desired wave length range. Further, the radiation generating element 50 is also provided on its exterior face with a C-shaped conductive ring 56. Connected to the lower end of the ring 56, in the manner as illustrated in FIGS. 1 and 2 are a pair of terminals 58. These terminals are, in turn, connected through electrical conductors 60 to a source of electrical power (not shown). In the illustrated embodiment, the electrical conductor 60 may pass through the handset 10 of the telephone instrument and then physically extended through the convolutions in the conductor 20 connecting the handset to the telephone base 12. Furthermore, the conductors 60 may be connected through the base housing 12 of the telephone instrument and to the source of electrical power. Otherwise, an electrical power conductor could be wired directly to the handset of the telephone instrument T.

As indicated above, the foil 54 is located immediately rearwardly of the radiation generating element. This reflection foil covers a substantial portion of the interior surface of the element 50. This foil, may adopt any suitable form of reflecting member capable of reflecting the generated radiation to the desired area. In a preferred embodiment, the foil may be a simple inexpensive aluminum foil material.

When the radiation generating element 50 is energized by electrical power, it is constructed to generate radiation of a wavelength and in amounts sufficient to destroy the bacteria on the telephone instrument. In one embodiment, the radiation is ultraviolet radiation. More specifically the generated radiation is of a wave length sufficient to destroy bacteria which normally collects on the mouthpiece of the telephone handset. Moreover, the radiation is of sufficient intensity to destroy all such bacteria which normally accumulates as a result of close mouth relationship to the mouthpiece of the telephone handset.

It should be understood that the radiation is not that intense so as to cause any injury to a human being who ocassionally walks nearby the handset. It is understood, however, that ultraviolet radiation over a substantial period of time could be injurious to a human being in close proximity. The radiation generating element 50 is designed so that the intensity is only sufficient to destroy the bacteria which normally accumulates on the mouthpiece, but is dissipated very quickly a short distance beyond the mouthpiece. Thus, it would be necessary for a human being to be in very close proximity e.g., a few inches, of the mouthpiece of the telephone instrument, or the portion of the instrument where the element 50 is used, for a very substantial period of time before any injury or damage would result.

One of the unique aspects of the invention is that the radiation generating element can be easily connected to a conventional telephone handset or other portion of a conventional telephone instrument. In this respect, the end cap 38 may be easily removed from the handset and the radiation generating element 50, which exists in the form of a thin flat disc, may be inserted in close proximity, that is essentially adjacent to the housing 30.

In this way, the overall construction of the telephone handset, itself, is not altered. It is only necessary to run the electrical conductors 60 through the telephone handset and out of the telephone handset for connection to a source of electrical power. As indicated previously, these conductors 60 can be easily run right through the convolutions of the cable 20 in the telephone handset. In this way, there is no additional loose wire conductor extending from the telephone handset through the telephone base. For that matter, the conductors 60 could also extend into and through the wire which connects the telephone instrument base 12 to a wall connection or the like.

In connection with the present invention, it should be understood, that the term "base" in the illustrated embodiment represents a telephone instrument base housing 12. However, the base or base housing could also represent the instrument portion which attaches to the wall or other stationary structure, as for example, in a coin operated telephone instrument.

In order to further protect the user of the telephone instrument from contact with any harmful radiation, the apparatus of the present invention is provided with a switch means 62 which, in the illustrated embodiment, may be located immediately beneath the telephone handset 10 when the latter is disposed on the cradle 14. The switch means 62 comprises a switch housing 64 and a base plate 66, the latter of which is provided for attachment to the telephone base housing 12. Thus, the base plate 66 may be provided with an adhesive coating on its under surface for adhesive attachment to the base housing 12 or otherwise, it may be provided with apertures for receiving mechanical fasteners (e.g. screws or the like).

The switch housing 64 is provided on its upper surface with a switch contact 68, the latter of which may be shiftable in order to open and close the switch means. Thus, when the telephone handset is disposed on the cradle 14, the shiftable contact 68 would be pushed downwardly thereby closing the switch means, that is to complete an electrical circuit path and permit electrical current to pass through the conductors 60. However, when the handset is raised from the cradle 14, the shiftable contact 68 would be biased upwardly, by means of a spring (not shown) in the switch housing 64 so that the switch means is then opened, shutting off electrical current to the conductors 60, thereby energizing the radiation generating element 50. In this respect, any conventional form of switch could be employed for connecting and disconnecting the electrically energizable element 50 from the source of electrical power in response to the removal and return of the handset 10 on the cradle 14.

In the illustrated embodiment, the conductors 60 may be connected directly to the switch means 62 in the manner as illustrated, particularly as shown in FIG. 5 of the drawings. In this way, the switch is electrically interposed directly in between the source of electrical power and the radiation generating element 50. Thus, for example, the switch means 62 could be connected to the conductors 60 internally in the telephone instrument base housing 12.

In another embodiment of the invention, the conductive ring 56 could adopt the form of a tube containing mercury and the two terminals 58 would be terminals, as for example, cathodes of a mercury switch. In this way, these components would form a mercury switch which could be connected to the radiation generating element thereby eliminating the need for a switch located below the telephone handset in the manner as illustrated. The mercury switch would be arranged so that the switch would be open, that is, no electrical contact between the two terminals 58 when the handset 10 is off of the cradle 14. However, when the handset 10 is placed back on the cradle 14, the mercury would flow back into a position where the switch was closed, e.g. electrical conduction between the two terminals 58 so that the radiation could again be generated. The use of the mercury switch has not been illustrated separately from that illustrated in FIGS. 1–3 since it would adopt the same outer appearance as the conductive ring 56 and terminals 58.

FIG. 3 of the drawings illustrates another embodiment of the invention in which the radiation generating element 50 is disposed externally of the mouthpiece of the conventional telephone handset. Thus, the radiation generating element 50 is disposed exteriorly of the cover plate 40 in the telephone handset, as illustrated in FIG. 3, and is provided with an additional outer cap 70 which retains the radiation generating element 50 in close proximity to the cover plate 40. Further, the radiation generating element 50 is also provided with the conductors 60 which also extend around the removable cap forming part of the mouthpiece and to the electrical cable 20 for extension through the convolutions of the cable 20 in the manner as previously described.

The end cap 70 may be provided at its rearward end with an inwardly struck angular flange 72 for engaging with a groove 74 existing between the end cap on the telephone handset and the remaining portion of the telephone handset itself. Any other form of attachment of the outer cap 70 may provided inasmuch as it is generally present for retaining the radiation generating element 50 in close proximity to the cover plate 40. Otherwise, the embodiment of the invention as illustrated in FIG. 3 operates in essentially the same manner as the previously described embodiment of the invention.

In another embodiment of the present invention, it is possible to use a radiation generating element which may not require the use of a source of power as for example, electrical power for operation. Thus, for example, the radiation generating element could be formed of tritium e.g. tritium $H_3$ or otherwise be provided with a coating of tritium for providing a source of bacteria destroying radiation. In this way, a low level of radiation could be provided which should not be harmful to users of the telephone instrument. The tritium could be used in place of, or otherwise in addition to, the use of ultraviolet radiation which is generated through the use of the electrical power. The tritium can be used without an interlock or safety switch in many cases due to the fact that the levels of radiation emitted therefrom are not normally harmful to human beings.

Thus, there has been illustrated and described a unique and novel bacteria destroying apparatus for use with a voice communication system and which is capable of generating bacteria destroying radiation when electrically energized. Thus, the illustrated and described apparatus fulfills all of the objects and advantages sought therefor. It should be understood that many changes, modifications, variations and other uses and applications will become apparent to those skilled in the art after considering this specification and the accompanying drawings. Therefore, any and all such changes, modifications, variations and other uses in applications, which become apparent to those skilled in the art, after considering this specification and the accompanying drawings, are deemed to be covered by the invention which is limited only by the following claims.

Having thus described my invention, what I desire to claim and receive by Letters Patent is:

1. An improved telephone system having a handset with a bacteria destroying means associated with the mouthpiece of said handset, said telephone system comprising:

(a) a telephone base;

(b) a handset operatively connected to said base;

(c) a mouthpiece on said handset having an outer casing, said outer casing having a perforated wall permitting passage of sound waves;

(d) a diaphram located within said handset and located in proximity to said perforated wall of said casing;

(e) a thin flat radiation generating disc located between said diaphram and the perforated wall on the outer casing of said handset, said disc having means capable of generating radiation in a wave length range which is effective to destroy said bacteria when energized and which radiation will contact said mouthpiece and the perforated wall of said casing, said disc also having a plurality of apertures therein permitting passage of sound waves therethrough to contact said diaphram;

(f) a conductive ring section mounted on said disc;

(g) electrically conductive means operatively connected to said conductive ring section on said disc through said handset to cause energization of the means generating radiation and thereby causing generation of the radiation to be incident on the perforated wall of said casing; and (h) a reflecting foil on the side of said disc closest to said diaphram reflecting the generated radiation toward said perforated wall and which reflecting foil still permits passage of sound wave to contact said diaphram.

2. The improved telephone system of claim 1 further characterized in that a coiled wire connects said handset to said base and said coiled wire has a plurality of spaced convolutions therein, said means to cause energization comprises an electrically conductive wire which extends from said handset through the convolutions in said coiled wire to said telephone base and to a source of electrical power.

3. The improved telephone system of claim 2 further characterized in that said electrically conductive means extends through a portion of said handset and being operatively connected to said radiation generating disc, said conductive means being adapted for ultimate connection to a source of electrical power to enable energization of said radiation generating element and ultimate generation of the radiation.

4. The improved telephone system of claim 3 further characterized in that said element is constructed to generate ultraviolet radiation.

5. The improved telephone system of claim 4 further characterized in that said radiation generating element comprises a coating of radioactive tritium on said relatively thin flat disc.

6. The improved telephone system of claim 4 further characterized in that said electrically conductive means comprises an electrical conductor connected to said disc which extends outwardly of said system for connection to a source of electrical power independent of said system.

7. The improved telephone system of claim 3 further characterized in that said system comprises switch means operatively connected to said electrically conductive means to enable deenergization of said radiation generating element when said telephone system is used.

8. The improved telephone system of claim 7 further characterized in that said switch means is located under the handset of a telephone instrument and permits energization of said radiation generating means when said handset is on a cradle, and stops energization when said handset is removed from the cradle.

* * * * *